US007735398B2

(12) United States Patent
Hsu et al.

(10) Patent No.: US 7,735,398 B2
(45) Date of Patent: Jun. 15, 2010

(54) RECHARGEABLE MOTOR-DRIVEN RATCHET WRENCH HAVING POWER-OFF PROTECTION

(75) Inventors: Chih-Hua Hsu, Taichung (TW); Chen-Chen Cheng, Taichung (TW)

(73) Assignee: Techway Industrial Co., Ltd. (TW)

( * ) Notice: Subject to any disclaimer, the term of this patent is extended or adjusted under 35 U.S.C. 154(b) by 793 days.

(21) Appl. No.: 11/705,501

(22) Filed: Feb. 13, 2007

(65) Prior Publication Data

US 2008/0190246 A1 Aug. 14, 2008

(51) Int. Cl.
*B25B 21/00* (2006.01)

(52) U.S. Cl. ..... 81/57.39; 81/57.11; 81/57.13; 81/57.14; 81/57.29; 81/467; 81/469

(58) Field of Classification Search ..... 81/57.39, 81/57.11, 57.13, 57.14, 57.29, 467, 469
See application file for complete search history.

(56) References Cited

U.S. PATENT DOCUMENTS 4,974,475 A 12/1990 Lord et al.
5,203,242 A * 4/1993 Hansson ..... 81/469
5,231,901 A 8/1993 Putney et al.
5,636,698 A * 6/1997 Estep et al. ..... 173/2
6,311,583 B1 11/2001 Izumisawa
6,715,380 B2 4/2004 Listl et al.
6,836,614 B2 * 12/2004 Gilmore ..... 388/811
6,915,721 B2 * 7/2005 Hsu et al. ..... 81/57.13
7,011,000 B2 * 3/2006 Kushida et al. ..... 81/302
7,649,337 B2 * 1/2010 Uehlein-Proctor et al. .. 320/112

FOREIGN PATENT DOCUMENTS

JP 2004106161 4/2004

* cited by examiner

*Primary Examiner*—Joseph J Hail, III
*Assistant Examiner*—Robert Scruggs
(74) *Attorney, Agent, or Firm*—Hershkovitz & Associates, LLC; Abraham Hershkovitz

(57) ABSTRACT

A rechargeable motor-driven ratchet wrench having power-off protection of the present invention includes a motor, a rechargeable battery and a power-off protection device. When the loaded current of the motor exceeds a set default value of a reference circuit, the power-off protection device disconnects the power supply of the rechargeable battery, so as to stop the motor operation. With the circuit design of the power-off protection device, the ratchet wrench can be ensured to provide usage safety and also usage lifespan of the ratchet wrench can be extended.

18 Claims, 7 Drawing Sheets

RECHARGEABLE MOTOR-DRIVEN RATCHET WRENCH HAVING POWER-OFF PROTECTION

BACKGROUND OF THE INVENTION

1. Field of the Invention

The invention relates in general to a motor-driven ratchet wrench, and more particularly to a motor-driven ratchet wrench that can be recharged by a rechargeable battery and also can extend usage lifespan with a power-off protection.

2. Description of the Related Art

A conventional ratchet wrench is a common tool for locking or loosing a screw nut. The conventional ratchet wrench includes manual, pneumatic or motor-driven modes. The pneumatic or motor-driven ratchet wrench, as disclosed in description of U.S. cm Pat. No. 6,915,721, can provide faster speed to lock or to loose the screw nut than the manual one.

However, when using the conventional motor-driven ratchet wrench, torque of the last spin or the first spin is often very huge. At that time, the loaded current of the ratchet wrench is biggest. If a user cannot hold the ratchet wrench, a body of the ratchet wrench may harm the user. On the contrary, if the user holds the ratchet wrench too tight, the motor might be burnt out due to huge current passing through.

Therefore, the present invention provides a new ratchet wrench to overcome the forgoing mentioned drawbacks of conventional ratchet wrench.

SUMMARY OF THE INVENTION

An objective of the present invention is to provide a rechargeable motor-driven ratchet wrench having power-off protection to make sure that the ratchet wrench can stop operation when loaded current exceeds a safe range. Therefore, the rechargeable motor driven ratchet wrench provides a safety of usage.

In order to achieve the above-described objective, the rechargeable motor-driven ratchet wrench having power-off protection in accordance with the present invention includes a body, a motor hold by the two half cases, a rechargeable battery hold by the two half cases electrically connected to the motor, an electrical socket, a switch and a planetary gear assembly. The present invention further includes a locating ring, a ratchet part and a power-off protection device.

The power-off protection device can detect the loaded current of the motor. If the loaded current passing through the motor exceeds the safe range, the power-off protection device disconnects the power supply, so as to protect the motor and avoid the motor to be burnt out. Hence the usage lifespan of the ratchet wrench can be extended.

Other objectives, advantages and novel features of the invention will become more apparent from the following detailed description when taken in conjunction with the accompanying drawings.

DETAILED DESCRIPTION OF THE INVENTION

Figure 1:
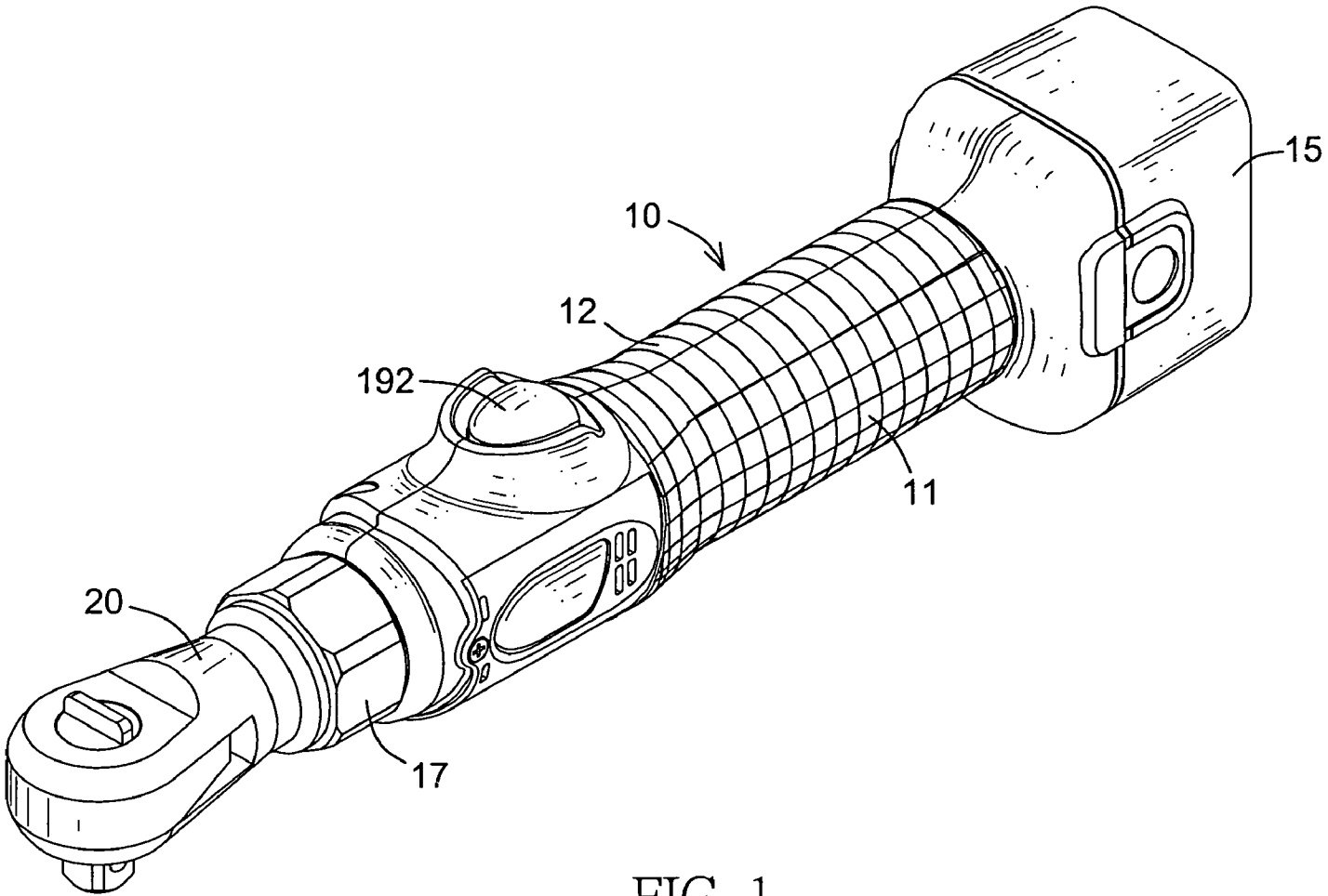
FIG. 1 is a perspective view of a first embodiment of a ratchet wrench in accordance with the present invention.
Figure 2:
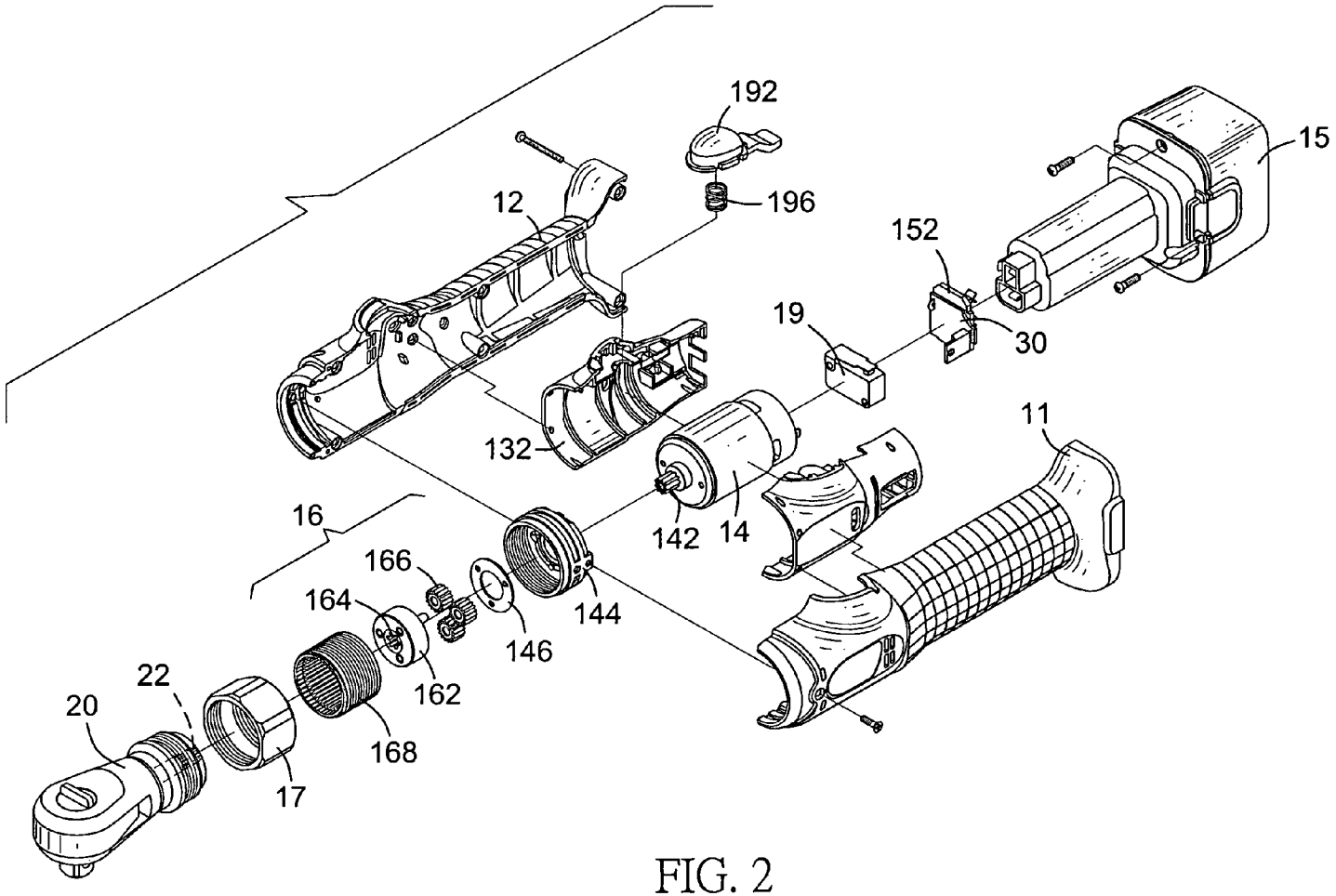
FIG. 2 is perspective exploded view of the first embodiment in accordance with the present invention.
Figure 3:
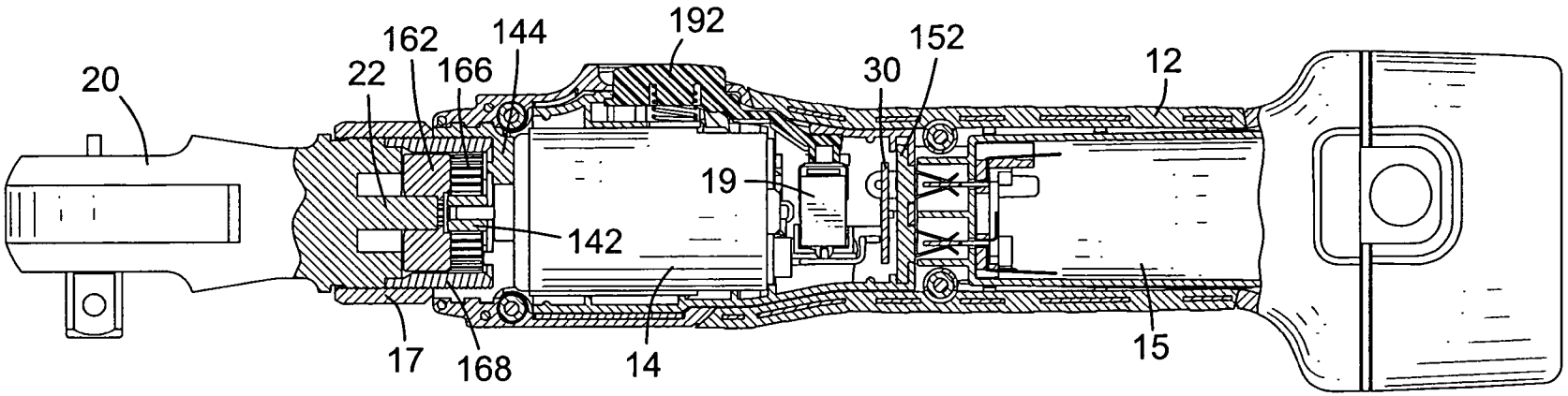
FIG. 3 is a portion cross sectional side view of the first embodiment in accordance with the present invention.

With reference to FIG. 1, a rechargeable motor-driven ratchet wrench having power-off protection of the present invention includes a body 10 and a ratchet part 20 configured at one end of the body 10. With reference to FIG. 2 and FIG. 3, the body 10 is assembled by two half cases 11 and 12 covering together. The two half cases 11 and 12 can be locked and fixed by screw bolts. Further, two insulation parts 132 of semicircle cross-sections are respectively formed inside two opposite sides of the two half cases 11 and 12.

A motor 14 and a rechargeable battery 15 are held by the two half cases 11 and 12. The rechargeable battery 15 is electrically connected to the motor 14 to supply operation power to the motor 14. A switch 19, a power-off protection device 30 and an electrical socket 152 are configured between the motor 14 and the rechargeable battery 15. Furthermore, the motor 14, the switch 19, the power-off protection device 30, and the electrical socket 152 are located and hold by the two insulation parts 132.

The electrical socket 152 is configured with two pings for coupling with two electrodes of the rechargeable battery 15. The switch 19 is electrically connected to the electrical socket 152 and the motor 14, so as to control the electrical connection and disconnection between the rechargeable battery 15 and the motor 14 by the switch 19. Further, a shaft is configured at one end of the motor 14. The end, where the shaft is configured, is distant from the rechargeable battery 15. A gear 142 is further configured on the shaft. A button 192 is formed between a border between the two insulation parts 132, extending outside the body 10 and corresponding to the switch 19 held by the two insulation parts 132. Furthermore, a spring 196 is passing through a border between the two insulation parts 132 to configure against the button 192 and the bottom 192. Hence when the button 192 outside of the body is pushed, the switch 19 can be controlled to be open or closed.

A planetary gear assembly 16 is located between the two half cases 11,12 and driven by the gear 142 of the motor 14. The planetary gear assembly 16 includes a rotation base 162 and three planetary gears 166, and is used to provide a lower rotating speed than that of the shaft of motor. The planetary gears 166 are configured at one side of the rotation base 162. The side, where the planetary gears are configured, faces the motor 14. The planetary gears 166 engage with the gear 142 of the shaft of the motor 14. A transmission gear 164 is formed at the other side of the rotation base 162 opposite to the motor 14.

The planetary gear assembly 16 further includes a toothed ring 168 for holding the rotation base 162 and the planetary gears 166. An inner toothed part is formed on an inner side of the toothed ring 168 to be engaged with the planetary gears 166. One end of the toothed ring 168 is spirally coupled to an inner screw thread of a connector 17 by an outer screw thread, and the other end of the toothed ring 168 is spirally coupled to a locating ring 144. The locating ring 144 is configured between the toothed ring 168 and the two half cases 11 and 12.

The ratchet part 20 is configured at one end of the body 10. That is, one end of the ratchet part 20 is configured with an outer screw thread to be spirally coupled to the corresponding inner screw thread of a connector 17. In this way, the ratchet part 20 is assembled to one end of the body 10 by the connector 17. A ratchet configuration is configured inside the ratchet part 20. The ratchet configuration is similar to the conventional one, so as to omit unnecessary details. Moreover, the ratchet configuration is configured with a drive shaft 22 stretching out of the ratchet part 20. The drive shaft 22 also engages with the transmission gear 164 of the rotation base 162 of the planetary gear assembly 16.

Based on the foregoing description, when the button 192 is pushed to make the switch 19 conductive, the rechargeable battery 15 starts to supply operation power to the motor 14, so as to enable the shaft of the motor 14 to rotate. With a gear transmission of the inner toothed part of the toothed ring 168 and the planetary gears 166, the planetary gears 166 not only revolves on its own axis, but also revolves around the opposite toothed ring 168. Hence the rotation base 162 is driven to rotate, so as to further drive the ratchet configuration to operate via the connection of the transmission gear 164 and the drive shaft 22. In this way, a crew nut can be locked or loosed.

At this moment, since the operation of the ratchet configuration is driven by the motor 14 and the power is provided by the rechargeable battery 15, the ratchet wrench does not need to connect to external voltage source or power source, so as to make the ratchet wrench portable and easy to be carried to any places to work. Hence the ratchet wrench in accordance with the present invention becomes much handier and more convenient than the conventional ratchet wrench. Furthermore, when the rechargeable battery 15 is used up, the rechargeable battery 15 can be removed from the body 10 to be recharged or can be replaced by another new rechargeable battery 15. Therefore usage lifespan of the ratchet wrench can be extended.

In addition, the locating ring 144 can be configured between the two half cases 11 and 12 for the shaft of the motor to pass through. In this way, the locating ring 144 can support the shaft to stabilize the shaft when the shaft rotates. On the other hand, a pad 146 is configured between the planetary gears 166 and the locating ring 144, so as to avoid the planetary gears 166 and the locating ring 144 to be direct contact to further affect the rotation of the planetary gears.

Figure 4:
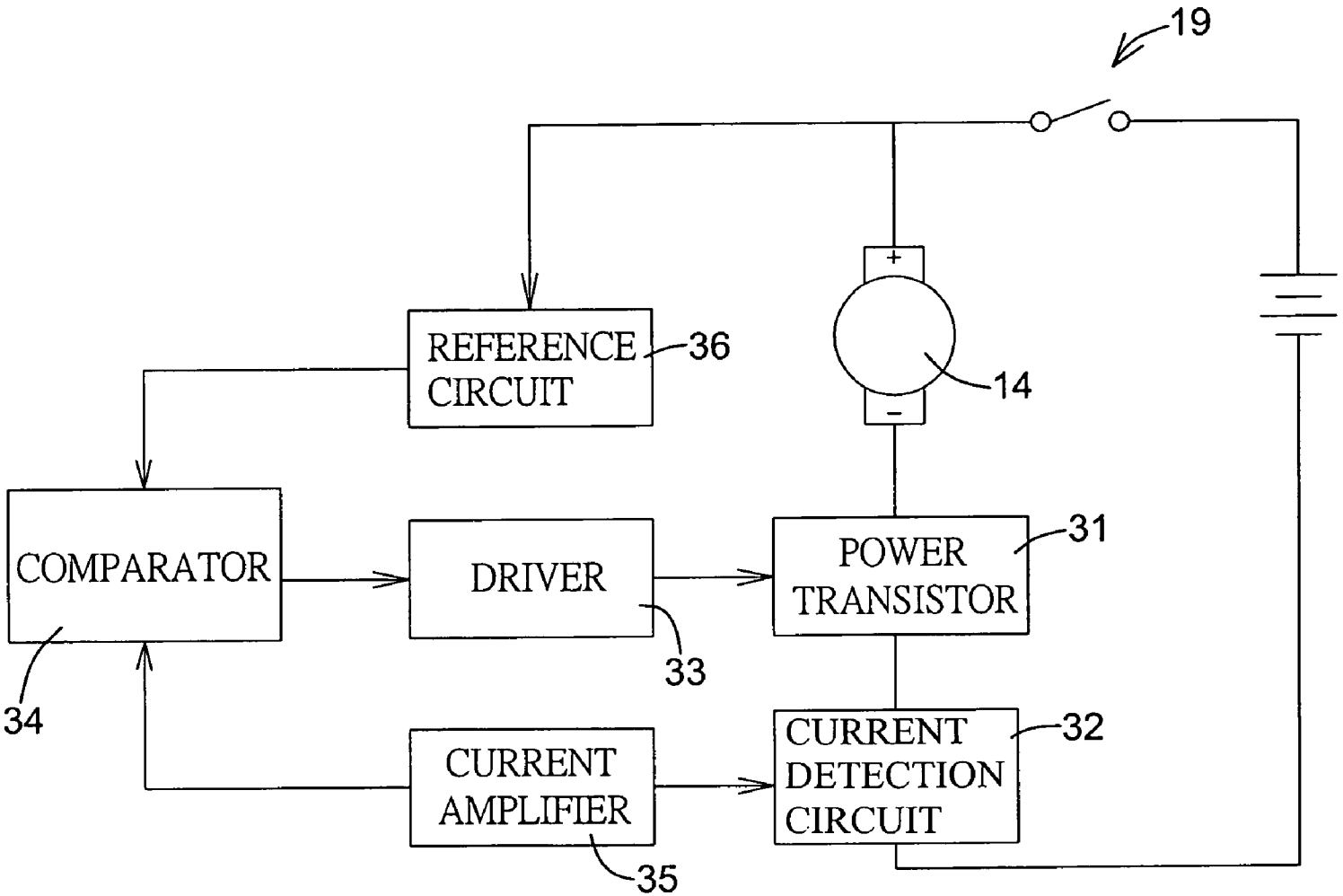
FIG. 4 is a circuit block diagram of a power-off protection device in accordance with the present invention.
Figure 5:
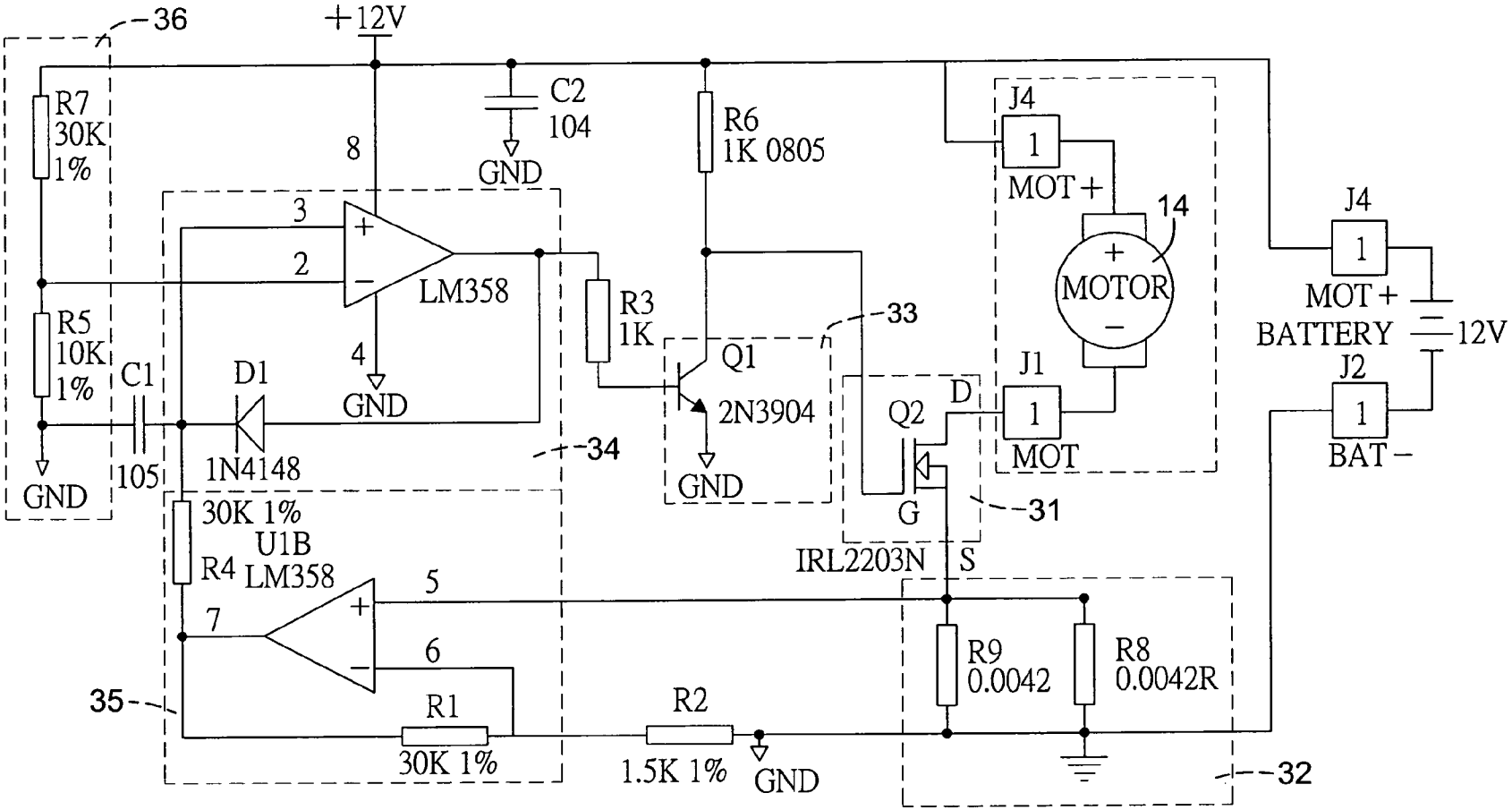
FIG. 5 is a detailed circuit diagram of the power-off protection device in accordance with the present invention.

With reference to FIG. 4, the power-off protection device 30 is configured between the switch 19 and the electrical socket 152. A circuit structure of the power-off protection device 30 includes a power transistor 31, a current detection circuit 32, a driver 33, a comparator 34, a current amplifier 35 and a reference circuit 36. With FIG. 5 a detailed circuit diagram of FIG. 4 is shown.

The power transistor 31 is made up by a field-effect transistor (hereafter "FET") Q2 having a drain and a gate to be respectively coupled to the motor 14 and the rechargeable battery 15.

The current detection circuit 32 is configured on the source of the FET Q2. The current detection circuit 32 detects the loaded current passing through the motor 14 via the FET Q2 to be coupled to the motor 14. In this preferred embodiment of an example of the present invention, the current detection circuit 32 is made up by two parallel resistors R8 and R9.

The driver 33 is made up by a BJT transistor Q1. A collector of the driver 33 is coupled to the rechargeable battery 15 and the gate of the power transistor Q2 to control the power transistor 31 to turn on or turn off.

The comparator 34 includes a first input terminal coupled to an output terminal of the current detection circuit 32 via the current amplifier 35. The other input terminal coupled to the reference circuit 36, which provide the comparator 34 a default value. An output terminal of the comparator 34 is coupled to a base of the BJT transistor Q1 via a resistance R3. The reference circuit 34 is used to set default value, which is the loaded current of disconnection protection value. In this preferred embodiment, the reference circuit 36 is made up by a voltage divider R5 and R7. To set the default value different resistance ratio of the voltage divider R5 and R7 may be changed.

The comparator 34 is used to determine whether the loaded current passing through the motor 14 is larger than the default value. In this preferred embodiment, the comparator 34 and the amplifying circuit 35 are made up by an operational amplifier of a chip No. LM358.

With the above-described circuit configuration, when the rechargeable battery 15 starts to supply power, the FET Q2 is conductive due to high electric potential of the gate, so as to electrify the motor 14 to operate. At the same time, the loaded current passing through the motor 14 is detected by the current detection circuit 32 via the FET Q2. Then the current detection circuit 32 generates a voltage signal immediately. The voltage signal is amplified by the current amplifier 35 and then to be sent to the comparator 34.

If the loaded current of the motor 14 does not exceed the default value of the reference circuit 36, the comparator 34 outputs low electric potential to the base of the BJT transistor Q1. Hence the BJT transistor Q1 is cut-off to let the rechargeable battery 15 continue supplying the power to the motor 14.

On the other hand, if the loaded current of the motor 14 exceeds the set default value of the reference circuit 36, the comparator 34 outputs a trigger signal of high electric potential to the base of the BJT transistor Q1 to make the BJT transistor Q1 conductive. At this moment, the BJT transistor Q1 is short to ground to make the gate of the FET Q2 cut-off. Hence the rechargeable battery 15 stops the power supply, so as to stop the motor operation. In this way, the motor 14 can be protected under over-current status, so as to ensure that the motor 14 will not be burnt out by overloading.

Figure 6:
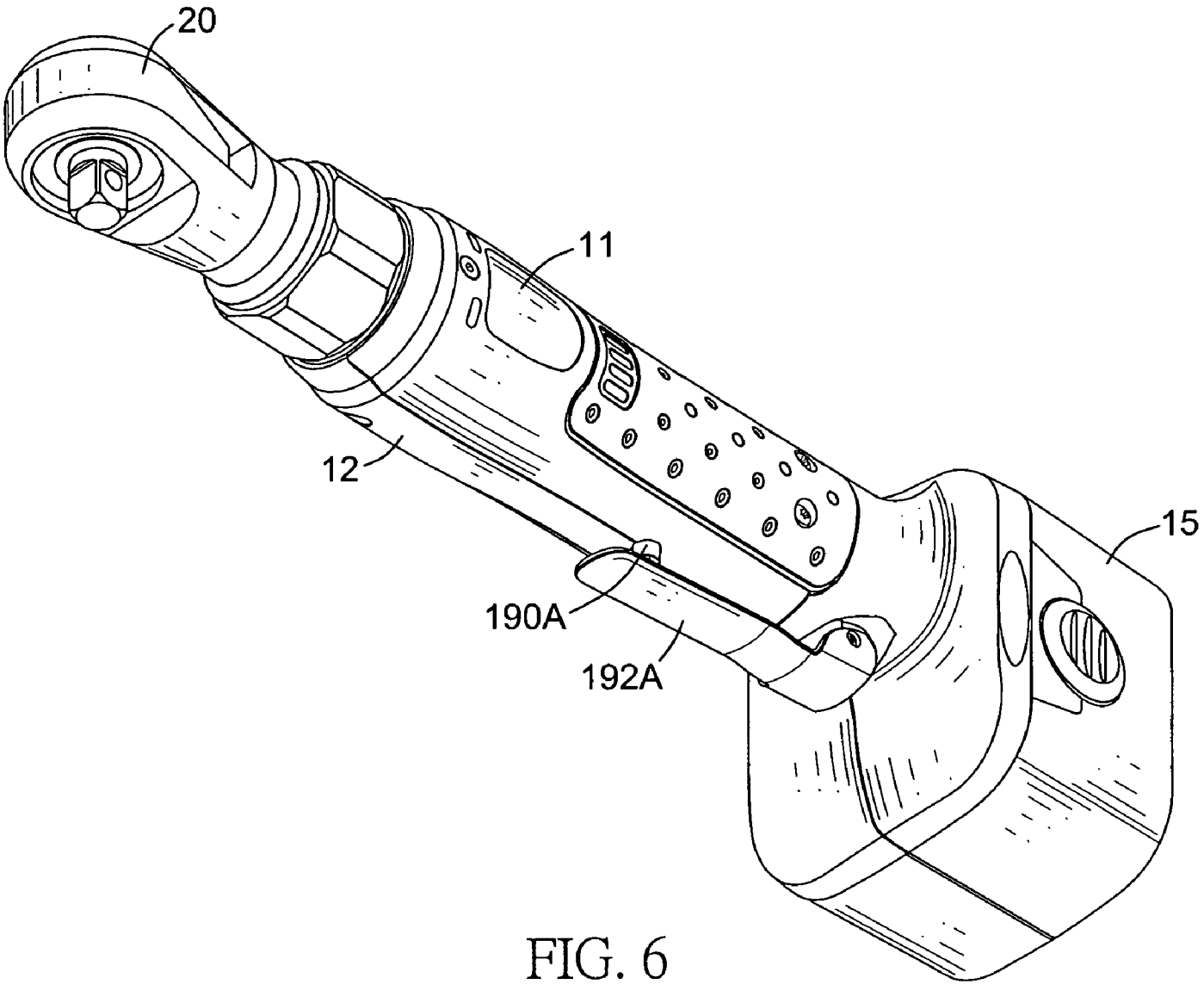
FIG. 6 is a perspective view of a second embodiment in accordance with the present invention.
Figure 7:
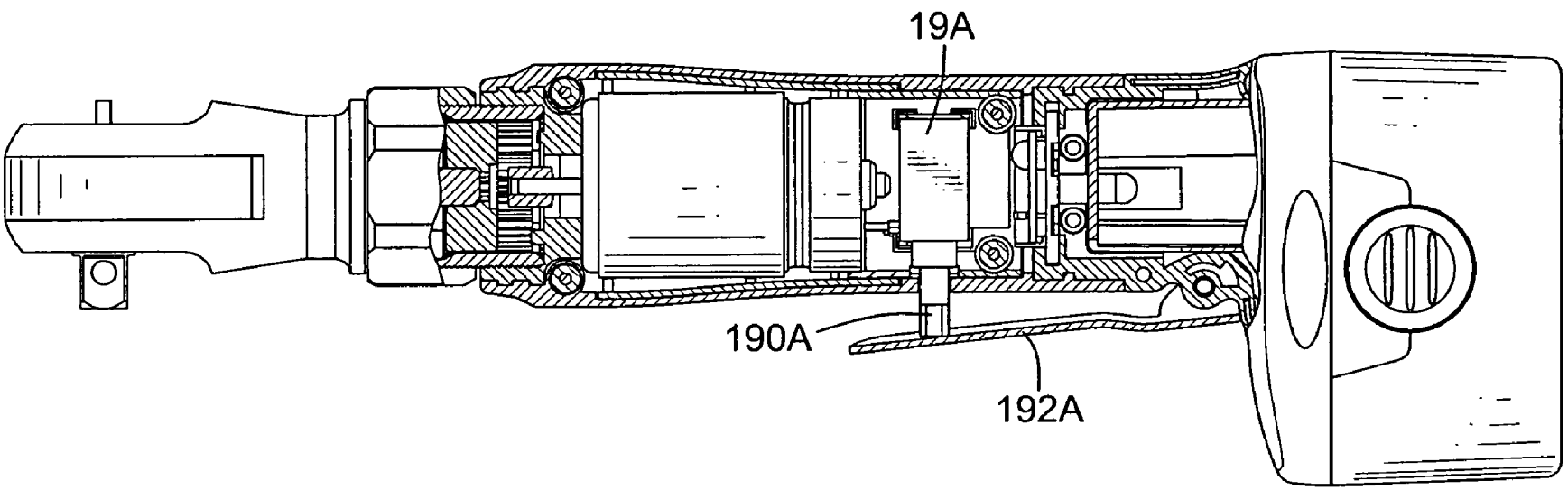
FIG. 7 is a portion cross sectional side view of the second embodiment in accordance with the present invention.

With reference to FIG. 6 and FIG. 7, a second embodiment of the present invention is shown. The difference between the first embodiment and the second embodiment is that the second embodiment provides a micro switch as a switch 19A. The micro switch includes a resilient rod 190A. One end of a buckling stem 192A is pivoted on an external wall of the two half cases 11, 12 near the rechargeable battery 15. The buckling stem 192A is of appropriate length with a free end corresponding to the resilient rod 190A of the switch 19A. When an user holds the two half cases 11, 12 and pushes the buckling stem 192A inwards, the free end of the buckling stem 192A will push the resilient rod 190A of the switch 19A to contract inwards to make the switch 19A conductive, so as to make the motor 14 operate. On the other hand, when the user releases the buckling stem 192As, the resilient rod 190A of the switch 19A recovers, so as to stop the operation of the motor 14.

To sum up, the rechargeable motor-driven ratchet wrench has a power-off protection of the present invention. While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A rechargeable motor-driven ratchet wrench having power-off protection comprising:

a body made up by two half cases covering together;

a motor hold by the two half cases, wherein a shaft is configured at one end of the motor and a gear is configured on the shaft of the motor;

a rechargeable battery held by the two half cases and electrically connected to the motor;

an electrical socket configured between the motor and the rechargeable battery having two pings for coupling with two electrodes of the rechargeable battery;

a switch for electrically connecting between the electrical socket and the motor;

a planetary gear assembly driven by the motor and comprising a rotation base, a plurality of planetary gears, a toothed ring, a transmission gear and a connector, wherein the planetary gears are configured at one side of the rotation base and facing the motor and the transmission gear is formed at the other side of the rotation base opposite to the motor, wherein the planetary gears respectively engage with the gear of the shaft of the motor, and the rotation base and the planetary gears are configured inside the toothed ring, wherein an inner toothed part is formed on an inner side of the toothed ring that engages with the planetary gears, wherein the toothed ring is spirally coupled to the connector;

a locating ring configured inside the two half cases and also spirally coupled to the toothed ring;

a ratchet part configured at one end of the body, wherein a ratchet configuration is configured inside the ratchet part and configured with a drive shaft, wherein the drive shaft is stretching out of the ratchet part and also coupled to the transmission gear of the rotation base; and a power-off protection device coupled between the switch and the electrical socket; wherein the power-off protection device comprises:

a power transistor coupled between the motor and the rechargeable battery;

a current detection circuit detecting loaded current, which is passing through the motor, via the power transistor to be coupled to the motor;

a driver coupled to the rechargeable battery and a gate of the power transistor; and a comparator having:

a first input terminal set to a default value;

a second input terminal coupled to an output terminal of the current detection circuit to determine whether the loaded current passing through the motor is larger than the default value; and an output terminal coupled to a control terminal of the driver.

2. The rechargeable motor-driven ratchet wrench having power-off protection as claimed in claim 1, further comprising a current amplifier configured between the current detection circuit and the second input terminal of the comparator.

3. The rechargeable motor-driven ratchet wrench having power-off protection as claimed in claim 2, further comprising a reference circuit is connected to the first input terminal of the comparator to set the default value.

4. The rechargeable motor-driven ratchet wrench having power-off protection as claimed in claim 1, wherein the current detection circuit is made up by two parallel resistors.

5. The rechargeable motor-driven ratchet wrench having power-off protection as claimed in claim 1, wherein the driver is made up by a BJT transistor, wherein a drain is coupled to the rechargeable battery and the gate of the power transistor.

6. The rechargeable motor-driven ratchet wrench having power-off protection as claimed in claim 2, wherein the comparator and the current amplifier are respectively made up by an operational amplifier.

7. The rechargeable motor-driven ratchet wrench having power-off protection as claimed in claim 3, wherein the reference circuit is made up by a voltage divider.

8. The rechargeable motor-driven ratchet wrench having power-off protection as claimed in claim 1, further comprising two insulation parts of semicircle cross-sections respectively formed inside two opposite sides of the two half cases, wherein the motor, the switch, the power-off protection device and the electrical socket are hold by the two insulation parts.

9. The rechargeable motor-driven ratchet wrench having power-off protection as claimed in claim 8, further comprising a button and a spring, wherein the button is formed between the two insulation parts and extending outside the body, wherein the spring is configured between the button and the switch inside of the two insulator parts.

10. The rechargeable motor-driven ratchet wrench having power-off protection as claimed in claim 9, wherein inside of the connector is formed an inner screw thread spirally coupled to an outer screw thread of the toothed ring.

11. The rechargeable motor-driven ratchet wrench having power-off protection as claimed in claim 10, wherein the locating ring is configured between the two half cases for the shaft of the motor to pass through, so as to support the shaft of the motor, wherein an inner side of the locating ring forms an inner screw thread, so as to be spirally coupled to the outer screw thread of the toothed ring.

12. The rechargeable motor-driven ratchet wrench having power-off protection as claimed in claim 11, wherein a pad is mounted between the planetary gears and the locating ring.

13. The rechargeable motor-driven ratchet wrench having power-off protection as claimed in claim 12, wherein one end of the ratchet part is configured with an outer screw thread to be spirally coupled to the corresponding inner screw thread of a connector.

14. The rechargeable motor-driven ratchet wrench having power-off protection as claimed in claim 1, further comprising a button and a spring, wherein the button is formed between the two insulation parts and extending outside the body, wherein the spring is configured between the button and the switch.

15. The rechargeable motor-driven ratchet wrench having power-off protection as claimed in claim 1, wherein inside of the connector is formed an inner screw thread spirally coupled to an outer screw thread of the toothed ring.

16. The rechargeable motor-driven ratchet wrench having power-off protection as claimed in claim 1, wherein the locating ring is configured between the two half cases for the shaft of the motor to pass through, so as to hold the shaft of the motor.

17. The rechargeable motor-driven ratchet wrench having power-off protection as claimed in claim 16, wherein a pad is mounted between the planetary gears and the locating ring.

18. The rechargeable motor-driven ratchet wrench having power-off protection as claimed in claim 1, wherein one end of the ratchet part is configured with an outer screw thread to be spirally coupled to the corresponding inner screw thread of a connector.

* * * * *